United States Patent [19]

Hewitt

[11] 3,941,322

[45] Mar. 2, 1976

[54] TEXTILE YARN PROCESSING

[75] Inventor: Arthur Raymond Hewitt, Manchester, England

[73] Assignee: Platt Saco Lowell Limited, Rossendale, England

[22] Filed: Jan. 29, 1974

[21] Appl. No.: 437,647

[30] Foreign Application Priority Data

Jan. 31, 1975 United Kingdom ..... 4840/75

[52] U.S. Cl. ..... 242/18 R; 242/18 A

[51] Int. Cl.[2] ..... B65H 67/04

[58] Field of Search ..... 242/18 A, 18 PW, 18 R, 242/25 A, 125.1

[56] References Cited

UNITED STATES PATENTS

| | | | |
|---|---|---|---|
| 2,481,031 | 9/1949 | McDermott | 242/18 PW |
| 2,706,089 | 4/1955 | Griset, Jr. | 242/18 R |
| 3,030,039 | 4/1962 | Roberts | 242/18 PW |
| 3,741,488 | 6/1973 | Wuest | 242/18 PW |
| 3,801,030 | 4/1974 | Kobatake et al. | 242/18 PW |

FOREIGN PATENTS OR APPLICATIONS

| | | | |
|---|---|---|---|
| 898,323 | 6/1962 | United Kingdom | 242/18 PW |
| 1,139,573 | 1/1969 | United Kingdom | 242/25 A |

*Primary Examiner*—Stanley N. Gilreath

*Attorney, Agent, or Firm*—Watson, Cole, Grindle & Watson

[57] ABSTRACT

In replacing a completed yarn package by an empty bobbin tube in a yarn processing machine, the running yarn delivered to the completed yarn package is severed, the severed yarn is delivered to a yarn collection zone, the running yarn is engaged with an empty bobbin tube without halting delivery of the yarn from the yarn collection zone, the completed yarn package is removed from a bobbin tube support and replaced by the yarn engaged with the empty bobbin tube while the yarn continues to be delivered to the yarn collection zone, and the empty bobbin is rotated to wind on yarn delivered to it to form a package thereon. While the running yarn is delivered to the yarn collection zone and before the empty bobbin tube is placed on the support, the yarn is so engaged with the bobbin tube that the running yarn is permitted to continue to pass to the yarn collection zone before and after the bobbin tube has been placed on the support and without rotation thereof and is so engaged that when the bobbin tube rotates the running yarn is constrained to rotate therewith to commence winding of the running on the tube. A reserve winding may be formed at one end of the empty bobbin from yarn withdrawn from the yarn collection zone.

15 Claims, 6 Drawing Figures

Figures 1, 2, 3, 4:
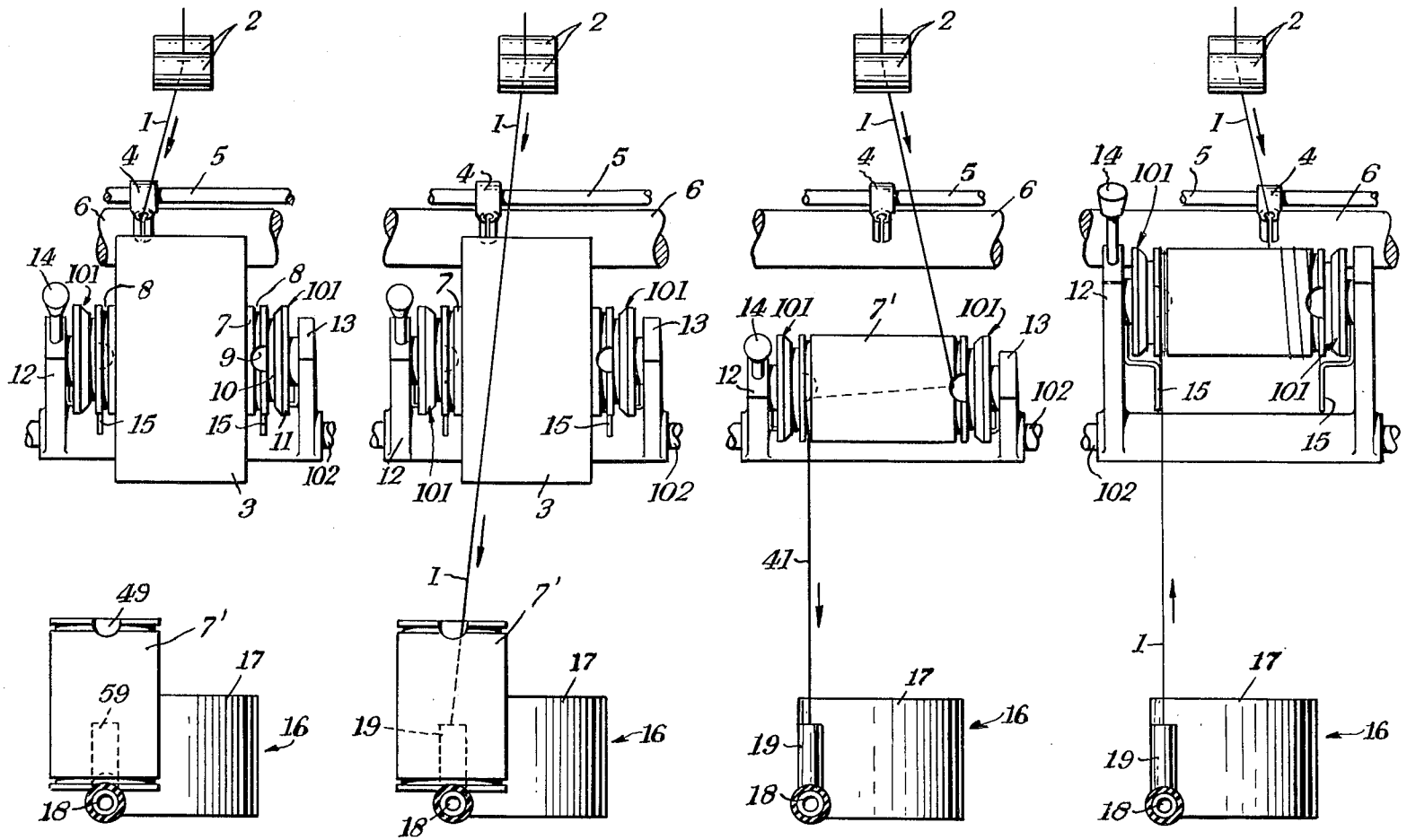

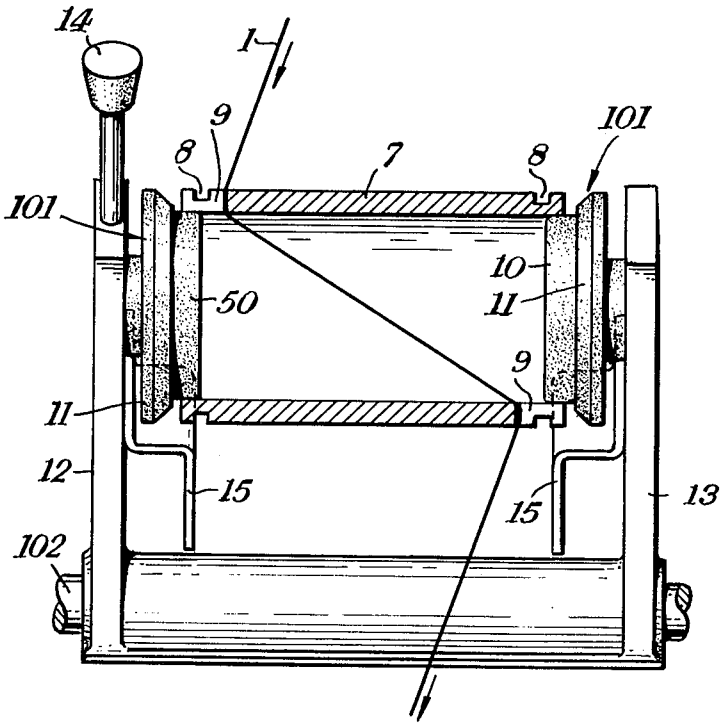
Fig. 6.
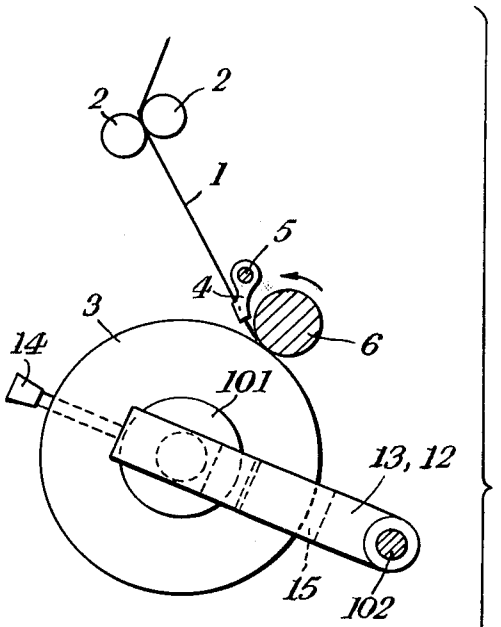
Fig. 5.
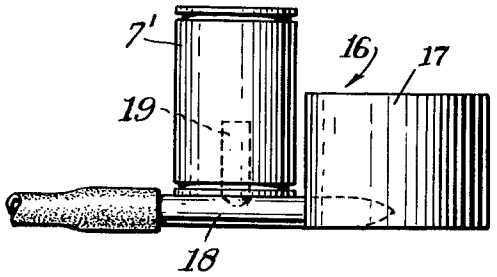

TEXTILE YARN PROCESSING

The present invention relates to textile yarn processing and more particularly to methods of an apparatus for replacing a bobbin having a completed yarn package thereon by an empty bobbin and for forming a reserve winding on a bobbin in a yarn processing machine.

In several types of textile yarn processing machines hitherto proposed it has been found desirable to have the facility for replacing a completed yarn package by an empty bobbin without interrupting the processing. For example, in an open-end yarn spinning process, when a completed yarn package is to be replaced by an empty bobbin for subsequent winding of a yarn package thereon, it is usual to interrupt yarn delivery from the spinning rotor. When the empty bobbin is in place, a length of yarn is attached to it and the end of yarn fed back into the spinning rotor where it contacts and twists in fibres fed thereto to effect piecing-up of the yarn. Such piecing-up is, however, undesirable since the section of yarn containing the piecing may not possess the desired characteristics required of the yarn.

In many instances, it is furthermore desirable to form a reserve winding of yarn on the empty bobbin at a position outside the axial extent of the package before commencing to form the package. This reserve winding is utilized in subsequent processing for connection to an end of yarn of a further package such that on depletion of yarn from one package delivery of yarn is continued by withdrawing yarn from the other package.

According to a first aspect of the present invention, there is provided a method of replacing a completed yarn package by an empty bobbin in a yarn processing machine, comprising the steps of severing the running yarn delivered to the completed yarn package, delivering the severed running yarn to a yarn collection zone, engaging said running yarn with an empty bobbin without halting delivery of said yarn to the yarn collection zone, removing said completed yarn package and replacing it by said empty bobbin whilst continuing the delivery of said yarn to said yarn collection zone, severing said yarn at a position following its engagement with the empty bobbin and commencing rotation of said empty bobbin to wind on yarn delivered thereto to form a yarn package thereon.

Preferably, the method according to the first aspect of the invention includes the further step of forming a reserve winding of yarn at one end of the empty bobbin by winding thereon yarn withdrawn from the yarn collection zone.

According to a second aspect of the present invention, there is provided a method of winding yarn on an empty bobbin in a yarn processing machine, comprising the steps of delivering a running yarn to a yarn collection zone, engaging said running yarn with an empty bobbin without halting delivery of the running yarn to the yarn collection zone, and rotating said empty bobbin to wind the running yarn thereon.

Preferably, the method according to the second aspect of the invention includes the step of forming a reserve winding at one end of the empty bobbin from yarn withdrawn from the yarn collection zone.

The method may according to the second aspect of the invention preferably further comprise the step of forming a yarn package on the bobbin.

Preferably, the bobbin comprises a hollow bobbin tube and the yarn-engaging step includes passage of the running yarn through the interior of the bobbin tube.

Preferably, the severed running yarn engages the tube by passing into the tube at one open end of the tube, through the tube and out of the tube at the other open end thereof.

According to a third aspect of the present invention there is provided apparatus for carrying out the method according to said first or second aspect of the invention, comprising a bobbin and bobbin supporting means for supporting the bobbin in such a manner as to provide a clearance between the bobbin supporting means and the bobbin to permit a running yarn which is passing through the bobbin before support thereof to continue to pass therethrough.

According to a fourth aspect of the present invention there is provided a bobbin tube formed with a passage or passages whereby when the tube is supported on bobbin supporting means a clearance is provided between the bobbin supporting means and the bobbin to permit a running yarn which is passing through the passage or passages before support thereof to continue to pass through the passage or passages during support thereof.

Preferably the passage or passages comprise a recess or cavity at each end thereof, whereby when the tube is supported at each end on bobbin supporting means a clearance is provided between the bobbin supporting means and the bobbin tube at each end thereof to permit a running yarn which is passing through the tube before support thereof to continue to pass into the tube at one end thereof, through the tube and out of the tube at the other end thereof.

According to a fifth aspect of the present invention, there is provided apparatus for carrying out the method according to the said first or second aspect of the invention, comprising bobbin supporting means for supporting a bobbin in such a manner as to provide a clearance between the bobbin supporting means and the bobbin to permit a running yarn which is passing through the bobbin before support thereof to continue to pass therethrough.

According to a sixth aspect of the present invention, there is provided apparatus for carrying out the method according to the second aspect of the invention comprising yarn collecting means for collecting a running yarn delivered thereto, an empty bobbin and bobbin rotating means, the empty bobbin being so adapted to engage said running yarn without halting delivery of the running yarn that when the bobbin is rotated by the bobbin rotating means the running yarn is wound thereon.

Preferably, the empty bobbin is so adapted to engage said running yarn that when the bobbin is rotated by the bobbin rotating means a reserve winding of yarn is formed at one end of the empty bobbin from yarn withdrawn from the yarn collection means.

Preferably, the yarn collection means comprises a suction tube in which the yarn is entrained in an airstream and a guide is preferably so located between the yarn collection means and the rotating bobbin that the yarn is constrained to travel in a path in which the yarn is wound at one end of the bobbin.

One embodiment of the invention will now be described by way of example with reference to the accompanying drawings in which:

FIG. 1 is a schematic front elevation of a winding head of a multi-station yarn processing machine according to the invention at a first stage in the replacement of a completed yarn package by an empty bobbin tube, FIGS. 2 to 4 are front elevations illustrating the winding head of FIG. 1 at three subsequent successive stages during bobbin replacement including the formation of a reserve winding, FIG. 5 is a side elevation of the winding head shown in FIG. 1, FIG. 6 is a part sectional front elevation through a bobbin tube mounted in position in the winding head of FIG. 1.

Referring firstly to FIGS. 1, 5 and 6, at each station of a multi-station machine a yarn 1 is delivered by a pair of delivery rollers 2 from, for example, an open-end spinning unit (not shown), to be wound on to a yarn package 3 with the aid of a yarn traverse guide 4 fixedly mounted on a longitudinally reciprocating bar 5 extending along the machine and serving also the other stations. Rotation of the yarn package 3 is effected by frictional engagement of the package 3 with a driving roller 6 extending along the machine and serving also to drive the yarn packages at the other stations.

The package is formed on a bobbin tube 7, which has a groove 8 provided in the cylindrical surface at each end thereof for a purpose hereinafter to be described. At the ends of the tube, there are formed two cavities 9 located in diametrically opposed relationship. As best seen in FIG. 6, the bobbin tube 7 is supported at each end on bobbin support members 101 formed with spigots 10 and flanges 11 and rotatably mounted on the ends of a pair of pivotal arms 12 and 13 pivotally mounted on a supporting shaft 102. When the tube 7 is in position between the support members 101, the spigots 10 project into the tube 7 by an amount less than the distance that the cavities 9 extend along the tube 7, thus providing a clearance between the tube 7 and each of the support members 101. A handle 14 is provided on one of the arms 12 and guide members 15 may also be provided on each of the arms 12 and 13 for a purpose hereinafter to be described.

Below the winding head a waste yarn collection unit 16 is provided. The unit 16 may be portable and brought to a particular winding head when required or such a unit may be provided at each winding head on the machine. The waste collection unit 16 comprises a waste collection chamber 17 having a compressed air inlet pipe 18 connected thereto. An upwardly projecting branch pipe 19 communicates with the air inlet pipe 18.

In FIG. 1, the yarn package 3 has reached completion and requires replacement by a new empty bobbin type 7′, on which the next yarn package is to be formed. Firstly, the empty bobbin tube 7′ is, as shown in FIG. 1, placed over the branch pipe 19 of the waste collection unit 16. The compressed air to the unit is switched on, thus creating a suction airstream down the branch pipe 19. The yarn is then severed at a point following the delivery rollers 2 and the end of yarn emerging from the rollers is, as shown in FIG. 2, caused to engage the empty bobbin 7′ by feeding the yarn through it to the inlet of the branch pipe 19, where it becomes entrained in the airstream and accumulates within the collection chamber 17. Rotation of the completed yarn package 3 is then stopped by disengaging it from the driving roller 6 whereupon the bobbin tube 7 with the package 3 is removed from the bobbin support members 101.

The new bobbin tube 7′ is next slid along the yarn 1 and, as shown in FIG. 3, placed on the bobbin support members 101. Delivery of the yarn from the rollers 2 continues and to ensure that it continues to be taken up by the collection chamber 17 the yarn is arranged to enter the tube at one end through the clearance between one of the cavities 9 and the associated spigot 10 and to leave the tube at the other end through the clearance between the other cavity 9 and the other spigot 10.

The arms 12 and 13 are pivotally raised to bring the bobbin tube 7′ into driving engagement with the driving roller 6, whereupon the yarn extending between the delivery rollers 2 and the bobbin tube 7′ is automatically picked up by the yarn traverse guide 4 and the formation of a new package is commenced. Simultaneously, a reserve length of yarn is formed in the groove 8 by withdrawing yarn accumulated in the waste collection unit 16. To aid in guiding the reserve length of yarn into the groove 8, the yarn is held against the surface of the guide member 15, which projects from the arm 12 to such an extent that the said surface lies in the same or substantially the same plane as the groove 8. When the desired reserve length of yarn has been wound in the groove 8, the yarn extending between the tube 7′ and the waste collection unit 16 is severed. Preferably, the grooves 8 cut through the boundaries of the cavities 9 and this aids in finding the rail end of yarn in the wound reserve length when the completed package is used in a subsequent process.

Thus, the formation of the reserve length of yarn is achieved in a simple manner without the necessity of providing mechanisms for displacing the yarn traverse guide outside the limits of its normal traverse. It will be appreciated that displacing the traverse guide outside the normal traverse is difficult to achieve since it is mounted on a traverse bar common to a plurality of winding heads. Only a single groove 8 need be provided, but the provision of a groove at each end of the tube ensures that the tube cannot be mounted wrongly handed on the bobbin support members 101.

The invention permits the removal of a completed yarn package and its replacement by a new empty tube in a simple manner without the necessity of discontinuing the supply of yarn. Thus the invention is suitable for application to a yarn producing machine operating on the open-end spinning principle, where, previously, it has been necessary to carry out the operation of piecing-up the yarn. This has been disadvantageous in that the section of yarn containing the piecing is unsuitable for subsequent processing since it may not possess the desired characteristics of the yarn. The invention overcomes this disadvantage by eliminating the piecing-up operation on starting the formation of a new package.

It will be appreciated that the clearance between the bobbin supporting means and the bobbin tube at each end of the tube by means of which the yarn can pass into the bobbin tube at one end thereof and out of the bobbin tube at the other end thereof may if desired be provided by cutting away a portion of or forming a recess in the bobbin supporting means at each end of the tube.

I claim:

1. A method of replacing a completed yarn package by an empty bobbin tube in a yarn processing machine including the steps of severing the running yarn delivered to the completed yarn package, delivering the severed yarn to a yarn collection zone, engaging said running yarn with an empty bobbin tube without halting delivery of said yarn to the yarn collection zone, removing said completed yarn package from a bobbin tube support and replacing it by the yarn engaged empty bobbin tube while continuing delivery of said yarn to said yarn collection zone and commencing rotation of said empty bobbin to wind on yarn delivered thereto to form a package thereon, characterized in that during the step of delivering the running yarn to the yarn collection zone and before the empty bobbin tube has been placed on the support, the yarn is so engaged with the bobbin tube that the running yarn is permitted to continue to pass to the yarn collection zone before and after the bobbin tube has been placed on the support and without rotation thereof and is so engaged that when the bobbin tube rotates the running yarn is constrained to rotate therewith to commence winding of the running yarn on the tube.

2. A method according to claim 1, including the further step of forming a reserve winding of yarn at one end of the empty bobbin by winding thereon yarn withdrawn from the yarn collection zone.

3. A method according to claim 1, including the further step of severing said yarn at a position in the path of travel of the yarn between the empty bobbin and the yarn collection zone before commencing the rotation of the empty bobbin.

4. A method of winding yarn on a empty bobbin in a yarn processing machine, comprising the steps of delivering a running yarn to a yarn collection zone, engaging said running yarn with an empty bobbin without halting delivery of the running yarn to the yarn collection zone, rotating said empty bobbin to wind the running yarn thereon, and forming a reserve winding at one end of the empty bobbin from yarn withdrawn from the yarn collection zone.

5. A method according to claim 3, comprising the step of continuing rotation of said empty bobbin to wind on yarn delivered thereto to form a yarn package on the bobbin.

6. A method according to claim 4 wherein the bobbin comprises a hollow bobbin tube and the yarn engaging step includes passing the running yarn through the interior of the bobbin tube.

7. A method according to claim 6 wherein the running yarn engages the tube by passing into the tube at one open end of the tube, through the tube and out of the tube at the other open end thereof.

8. A method according to claim 4 wherein the yarn is entrained in an airstream in said yarn collection zone.

9. Apparatus for winding yarn on an empty bobbin comprising yarn delivery means for continuously delivering a running yarn, a bobbin tube, and bobbin supporting means supporting the bobbin tube, yarn collection means for collecting a running yarn delivered by said delivery means, yarn passage means formed in the bobbin tube defining a yarn engaging portion and providing means defining a clearance between the tube and the bobbin supporting means when the tube is supported thereon for the passage of the yarn through the bobbin tube to the yarn collecting means.

10. Apparatus according to claim 9 wherein the passage means comprises means defining a cavity at each end of the bobbin tube to provide a means defining a clearance between the tube and the bobbin supporting means at each end to permit a running yarn to pass into the tube at one end thereof and out of the other end.

11. Apparatus according to claim 9 including a yarn guide located between the yarn collection means and the rotating bobbin tube constraining the yarn to travel in a path to produce a reserve winding at one end of the bobbin tube from yarn withdrawn from the yarn collection means.

12. Apparatus according to claim 9 wherein the yarn collection means comprises suction means producing an airstream in which the yarn is entrained.

13. Apparatus according to claim 9, wherein the passage means comprise two yarn passages formed in the bobbin tube to provide clearances between the tube and the bobbin supporting means to permit a running yarn to pass into the tube through one passage and out of the tube through the other passage.

14. Apparataus according to claim 9, wherein the yarn engaging portion engages the running yarn on rotation of the bobbin tube to withdraw yarn from the yarn collection means and form a reserve winding at one end of the bobbin tube.

15. Apparatus according to claim 13, wherein the bobbin supporting means include spigots projecting into the ends of the bobbin tube, and wherein the yarn passages form clearances with the spigots to permit a running yarn which is passing through the tube before support thereof to continue to pass through the tube after support thereof.

* * * * *